US007316463B2

(12) United States Patent
Ikemoto et al.

(10) Patent No.: US 7,316,463 B2
(45) Date of Patent: Jan. 8, 2008

(54) LIQUID EJECTING HEAD, LIQUID EJECTING DEVICE, AND LIQUID EJECTING METHOD

(75) Inventors: Yuichiro Ikemoto, Kanagawa (JP); Iwao Ushinohama, Kanagawa (JP)

(73) Assignee: Sony Corporation, Tokyo (JP)

( * ) Notice: Subject to any disclaimer, the term of this patent is extended or adjusted under 35 U.S.C. 154(b) by 124 days.

(21) Appl. No.: 10/513,717

(22) PCT Filed: May 6, 2003

(86) PCT No.: PCT/JP03/05657

§ 371 (c)(1),
(2), (4) Date: Nov. 4, 2004

(87) PCT Pub. No.: WO03/095211

PCT Pub. Date: Nov. 20, 2003

(65) Prior Publication Data

US 2005/0225583 A1 Oct. 13, 2005

(30) Foreign Application Priority Data

May 8, 2002 (JP) ..... 2002-133119

(51) Int. Cl.
*B41J 29/38* (2006.01)

(52) U.S. Cl. ..... 347/13; 347/12

(58) Field of Classification Search ..... 347/12
See application file for complete search history.

(56) References Cited

U.S. PATENT DOCUMENTS 5,790,140 A * 8/1998 Koizumi et al. ..... 347/12
5,975,670 A * 11/1999 Kikuta et al. ..... 347/15
6,296,340 B1 * 10/2001 Tajika et al. ..... 347/12
6,390,580 B1 * 5/2002 Anderson et al. ..... 347/9
6,520,613 B1 * 2/2003 Tamura ..... 347/12
6,598,951 B2 * 7/2003 Ikemoto et al. ..... 347/13
6,712,438 B2 * 3/2004 Han ..... 347/12
6,755,495 B2 * 6/2004 Beck et al. ..... 347/12
6,899,414 B2 * 5/2005 Kondoh et al. ..... 347/40
6,997,533 B2 * 2/2006 Nakajima et al. ..... 347/9

FOREIGN PATENT DOCUMENTS

JP 04301467 A * 10/1992
JP 2001-232780 8/2001
WO WO01/39981 6/2001

* cited by examiner

*Primary Examiner*—Matthew Luu
*Assistant Examiner*—Shelby Fidler
(74) *Attorney, Agent, or Firm*—Robert J. Depke; Rockey, Depke & Lyons, LLC.

(57) ABSTRACT

The present invention relates to a liquid ejecting head and a liquid ejecting device including a driving circuit with which the number of control signal lines for grouping and dividing a plurality of liquid ejecting mechanisms into a plurality of blocks and dividedly driving the groups of liquid ejecting mechanisms concurrently is reduced, and to a liquid ejecting method by the driving circuit. The driving circuit (19) includes a phase generating circuit (a phase counter 30 and decoders 31) for generating phase signals for dividedly driving the groups of liquid ejecting mechanisms, and a serial/parallel converting circuit (32) for parallel converting and serially transferring data for dividedly driving the groups of liquid ejecting mechanisms.

8 Claims, 7 Drawing Sheets

LIQUID EJECTING HEAD, LIQUID EJECTING DEVICE, AND LIQUID EJECTING METHOD

This application claims priority to Japanese Patent Application Number JP2002-133119, filed May 8, 2002 which is incorporated herein by reference.

TECHNICAL FIELD

The present invention relates to liquid ejecting heads, liquid ejecting devices, and liquid ejecting methods for ejecting liquid onto a recording medium from nozzles. More specifically, the present invention relates to a liquid ejecting head, a liquid ejecting device, and a liquid ejecting method that serves to reduce the number of control signal lines for each block in exercising control for dividing a plurality of liquid ejecting mechanisms of a head chip into a plurality of blocks by groups of a predetermined number of units and for dividedly driving the blocks concurrently.

BACKGROUND ART

In a conventional liquid ejecting device, such as an ink-jet printer, while relatively moving a sheet that serves as a recording medium and ink ejecting mechanisms that serve as liquid ejecting mechanisms in a predetermined direction, ink, which is a liquid, is ejected selectively from nozzles of the ink ejecting mechanisms sequentially arranged in a direction that is substantially perpendicular to the direction of the movement. Accordingly, ink droplets are ejected onto the sheet to form a desired image, whereby characters or the like are printed.

A printer head of the printer includes a head chip. The head chip includes a semiconductor substrate, a plurality of ink ejecting mechanisms sequentially arranged on the semiconductor substrate and having nozzles for ejecting ink, and a driving circuit for dividing the plurality of ink ejecting mechanisms into a plurality of blocks by groups of a predetermined number of units and for dividedly driving the blocks concurrently with reference to a predetermined driving timing signal, thereby causing ink to be ejected from the nozzles.

Such divided driving of a head chip of a printer head is controlled by a controlling scheme referred to as matrix driving. According to the scheme, all the nozzles of a head chip are divided into a plurality of blocks by groups of a predetermined number of units, and the blocks are dividedly driven concurrently, thereby causing ink to be ejected from the nozzles. In this case, the number of driving data lines needed is determined by dividing the total number of nozzles by the predetermined number of nozzles for each group, and the number of signal lines needed for phase signals is the same as the predetermined number of nozzles in each block. Such matrix driving is described, for example, in the specification of U.S. Pat. No. 5,604,519.

Furthermore, the specification of U.S. Pat. No. 5,006,864 describes a scheme in which phase signals to be transmitted to a predetermined number of nozzles in each block are serial-to-parallel converted before the phase signals are transferred.

However, regarding the conventional scheme for divided driving of a head chip of a printer head, according to the first example referred to as matrix driving, for example, when a head chip includes 336 nozzles and the nozzles are divided into a plurality of blocks by groups of 64 units, the number of driving lines is at least six since 336/64=5.25. Since the number of signal lines for phase signals is 64, the total number of control signal lines for divided driving is 70 for one head chip. Thus, the number of control signal lines in an individual head chip is large, so that wiring or bonding inside the head chip is difficult and the size of the chip is large.

In the case of a printer head including a plurality of head chips, for example, a printer head of a line head printer, for example, assuming that the printer head includes 64 head chips, the number of driving data lines is 6×64=384, and the number of signal lines for phase signals is 64, so that the total number of control signal lines for divided driving is 448. Thus, the number of control signal lines for the entire printer head including a plurality of head chips increases, causing increase in wiring space in the printer head and increase in the size of the printer head.

According to the second conventional example in which phase signals are serial-to-parallel converted before the phase signals are transferred, the number of signal lines needed for phase signals is the same as the predetermined number of nozzles in each group. When the predetermined number of nozzles for dividing into a plurality of blocks is increased, the number of control signal lines in an individual head chip increases. Thus, wiring or bonding in the head chip is difficult, and the size of the chip increases.

In view of the situation described above, it is an object of the present invention to deal with the problems described above and to provide a liquid ejecting head, a liquid ejecting device, and a liquid ejecting method that serves to reduce the number of control signal lines for each block in exercising control for dividing a plurality of liquid ejecting mechanisms of a head chip into a plurality of blocks by groups of a predetermined number of units and for dividedly driving the blocks concurrently.

DISCLOSURE OF INVENTION

In order to achieve the above object, a liquid ejecting head according to the present invention includes a head chip, the head chip including a semiconductor substrate, a plurality of liquid ejecting mechanisms sequentially arranged on the semiconductor substrate and having nozzles for ejecting liquid, and a driving circuit for dividing the plurality of liquid ejecting mechanisms into a plurality of blocks by groups of a predetermined number of units and for dividedly driving the plurality of blocks concurrently with reference to a predetermined driving timing signal, thereby causing liquid to be ejected from the nozzles, wherein the driving circuit of the head chip includes a phase generating circuit for generating phase signals for dividedly driving the groups of liquid ejecting mechanisms, and a serial/parallel converting circuit for parallel converting and serially transferring data for dividedly driving the groups of liquid ejecting mechanisms.

According to the arrangement described above, the phase generating circuit provided in the driving circuit of the head chip generates phase signals for dividedly driving the groups of liquid ejecting mechanisms, and the serial/parallel converting circuit parallel converts and serially transfers the data for dividedly driving the groups of liquid ejecting mechanisms. Accordingly, in the liquid ejecting head including the head chip, the plurality of liquid ejecting mechanism of the head chip is divided into a plurality of blocks by groups of a predetermined number of units and the plurality of blocks is dividedly driven concurrently.

A liquid ejecting head according to another invention includes a plurality of head chips, each of the plurality of head chips including a semiconductor substrate, a plurality of liquid ejecting mechanisms sequentially arranged on the semiconductor substrate and having nozzles for ejecting liquid, and a driving circuit for dividing the plurality of liquid ejecting mechanisms into a plurality of blocks by groups of a predetermined number of units and for dividedly driving the plurality of blocks concurrently with reference to a predetermined driving timing signal, thereby causing liquid to be ejected from the nozzles, wherein the driving circuit of each of the head chips includes a phase generating circuit for generating and controlling phase signals for dividedly driving the groups of liquid ejecting mechanisms, and a serial/parallel converting circuit for parallel converting and serially transferring data for dividedly driving the groups of liquid ejecting mechanisms, and wherein data lines for transmitting the data for dividedly driving the liquid ejecting mechanisms to the head chips are provided such that each set of a predetermined plural number of head chips is commonly connected to one of the data lines, so that the data is transmitted in a multiplexed manner.

According to the arrangement described above, the phase generating circuit provided in the driving circuit of each of the head chips generates and controls phase signals for dividedly driving the groups of liquid ejecting mechanisms, and the serial/parallel converting circuit parallel converts and serially transfers the data for dividedly driving the groups of liquid ejecting mechanisms. Data lines for transmitting the data for dividedly driving the liquid ejecting mechanisms to the head chips are provided such that each set of a predetermined plural number of head chips is commonly connected to one of the data lines, so that the data is transmitted in a multiplexed manner. Accordingly, in the liquid ejecting head including the plurality of head chips, the plurality of liquid ejecting mechanism of the head chip is divided into a plurality of blocks by groups of a predetermined number of units and the plurality of blocks is dividedly driven concurrently. Furthermore, the number of data lines for transmitting data to the plurality of head chips becomes the reciprocal of an integer.

In the above two inventions, the phase generating circuit includes a phase counter for generating phase signals with input of two lines of signals that serve as a phase reset signal and a phase clock for divided driving, and decoders for decoding the phase signals input from the phase counter, and wherein the serial/parallel converting circuit receives input of two lines of signals that serve as driving data and a data transfer clock for divided driving and carries out parallel conversion and serial transfer of data. Accordingly, the number of control signal lines is reduced in exercising control for dividing a plurality of liquid ejecting mechanism of a head chip into a plurality of blocks by groups of a predetermined number of units and for dividedly driving the plurality of blocks concurrently.

Furthermore, the decoders are provided on a one-to-one basis for the respective nozzles of the plurality of liquid ejecting mechanisms. Accordingly, even when the number of liquid ejecting mechanisms divided into a plurality of blocks by grouping is large, the number of signal lines connected to the decoders is reduced to the number of output signals from the phase counter.

A liquid ejecting device according to the present invention includes a liquid ejecting head that includes a head chip, the head chip including a semiconductor substrate, a plurality of liquid ejecting mechanisms sequentially arranged on the semiconductor substrate and having nozzles for ejecting liquid, and a driving circuit for dividing the plurality of liquid ejecting mechanisms into a plurality of blocks by groups of a predetermined number of units and for dividedly driving the plurality of blocks concurrently with reference to a predetermined driving timing signal, thereby causing liquid to be ejected from the nozzles, the liquid ejecting device allowing droplets to be ejected onto a recording medium from the nozzles of the liquid ejecting mechanisms, wherein the driving circuit of the head chip includes a phase generating circuit for generating phase signals for dividedly driving the groups of liquid ejecting mechanisms, and a serial/parallel converting circuit for parallel converting and serially transferring data for dividedly driving the groups of liquid ejecting mechanisms.

According to the arrangement described above, the phase generating circuit provided in the driving circuit of the head chip generates phase signals for dividedly driving the groups of liquid ejecting mechanisms, and the serial/parallel converting circuit parallel converts and serially transfers the data for dividedly driving the groups of liquid ejecting mechanisms. Accordingly, in the liquid ejecting device including the liquid ejecting head that includes the head chip, the plurality of liquid ejecting mechanism of the head chip is divided into a plurality of blocks by groups of a predetermined number of units and the plurality of blocks is dividedly driven concurrently.

A liquid ejecting device according to another invention includes a liquid ejecting head that includes a plurality of head chips, each of the plurality of head chips including a semiconductor substrate, a plurality of liquid ejecting mechanisms sequentially arranged on the semiconductor substrate and having nozzles for ejecting liquid, and a driving circuit for dividing the plurality of liquid ejecting mechanisms into a plurality of blocks by groups of a predetermined number of units and for dividedly driving the plurality of blocks concurrently with reference to a predetermined driving timing signal, thereby causing liquid to be ejected from the nozzles, the liquid ejecting device allowing droplets to be ejected onto a recording medium from the nozzles of the liquid ejecting mechanisms, wherein the driving circuit of each of the head chips includes a phase generating circuit for generating and controlling phase signals for dividedly driving the groups of liquid ejecting mechanisms, and a serial/parallel converting circuit for parallel converting and serially transferring data for dividedly driving the groups of liquid ejecting mechanisms, and wherein data lines for transmitting the data for dividedly driving the liquid ejecting mechanisms to the head chips are provided such that each set of a predetermined plural number of head chips is commonly connected to one of the data lines, so that the data is transmitted in a multiplexed manner.

According to the arrangement described above, the phase generating circuit provided in the driving circuit of each of the head chips generates and controls phase signals for dividedly driving the groups of liquid ejecting mechanisms, and the serial/parallel converting circuit parallel converts and serially transfers the data for dividedly driving the groups of liquid ejecting mechanisms. Data lines for transmitting the data for dividedly driving the liquid ejecting mechanisms to the head chips are provided such that each set of a predetermined plural number of head chips is commonly connected to one of the data lines, so that the data is transmitted in a multiplexed manner. Accordingly, in the liquid ejecting device including the liquid ejecting head that includes the plurality of head chips, the plurality of liquid ejecting mechanism of the head chip is divided into a plurality of blocks by groups of a predetermined number of units and the plurality of blocks is dividedly driven concurrently. Furthermore, the number of data lines for transmitting data to the plurality of head chips becomes the reciprocal of an integer.

In the above two inventions, the phase generating circuit includes a phase counter for generating phase signals with input of two lines of signals that serve as a phase reset signal and a phase clock for divided driving, and decoders for decoding the phase signals input from the phase counter, and wherein the serial/parallel converting circuit receives input of two lines of signals that serve as driving data and a data transfer clock for divided driving and carries out parallel conversion and serial transfer of data. Accordingly, the number of control signal lines is reduced in exercising control for dividing a plurality of liquid ejecting mechanism of a head chip into a plurality of blocks by groups of a predetermined number of units and for dividedly driving the plurality of blocks concurrently.

Furthermore, the decoders are provided on a one-to-one basis for the respective nozzles of the plurality of liquid ejecting mechanisms. Accordingly, even when the number of liquid ejecting mechanisms divided into a plurality of blocks by grouping is large, the number of signal lines connected to the decoders is reduced to the number of output signals from the phase counter.

BEST MODE FOR CARRYING OUT THE INVENTION

The present invention will now be described in more detail with reference to the accompanying drawings.

In embodiments described below, liquid ejecting devices are described in the context of ink-jet printers as examples. Thus, in the embodiments described below, liquid ejected by the liquid ejecting devices is ink.

Figure 1:
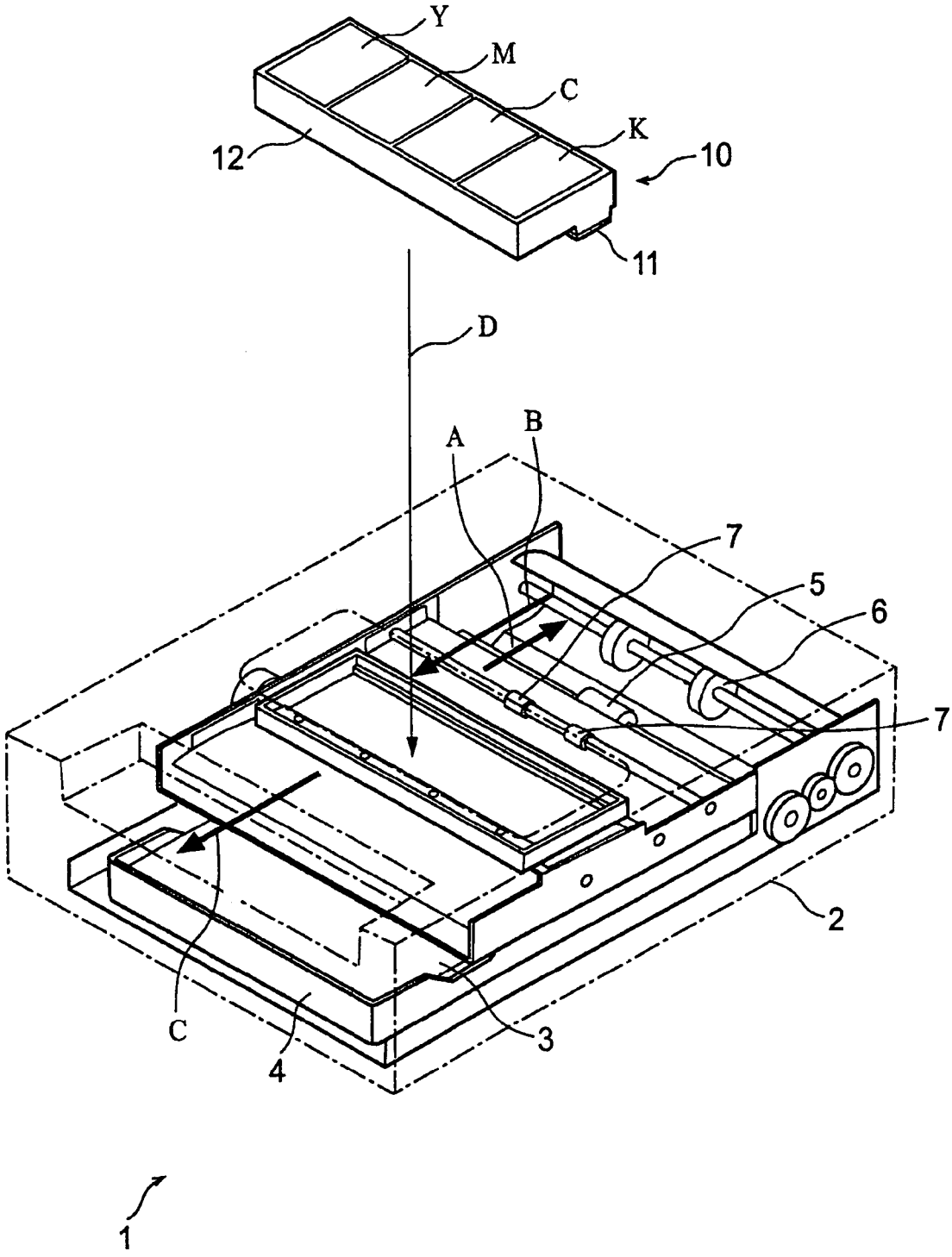
FIG. 1 is a perspective view showing an embodiment of a printer according to the present invention.

FIG. 1 is a perspective view showing an embodiment of a printer, which is an example of a liquid ejecting device according to the present invention. The printer 1 is, for example, an ink-jet line-head printer that ejects ink as a liquid from nozzles to form an image on a recording medium. The printer 1 is contained in a generally rectangular-parallelepiped case 2. In the printer 1, a sheet 3 can be fed by mounting a sheet tray 4 containing the sheet 3 from a tray slot provided on a front surface of the case 2.

When the sheet tray 4 is mounted on the printer 1 through the tray slot, the sheet 3 is pressed onto a sheet feeding roller 5 by a predetermined mechanism, and the sheet 3 is fed from the sheet tray 4 to a rear-surface side by the rotation of the sheet feeding roller 5, as indicated by an arrow A. On the side to which the sheet 3 is fed, a reverse roller 6 is provided, and the direction of feeding the sheet 3 is switched to the direction of the front surface by the rotation of the reverse roller 6, as indicated by an arrow B.

After the feeding direction is switched as described above, the sheet 3 is transported by a spur roller 7 so as to traverse above the sheet tray 4, and is ejected from a sheet ejecting slot provided on the front side, as indicated by an arrow C.

Between the spur roller 7 and the sheet ejecting slot, a head cartridge 10 is mounted exchangeably, as indicated by an arrow D. The head cartridge 10 includes line heads for yellow, magenta, cyan, and black. A printer head 11, which is a liquid ejecting head according to the present invention, is provided on a lower-surface side of a box-shaped holder 12, and ink cartridges Y, M, C, and K for yellow, magenta, cyan, and black are sequentially arranged in the holder 12. Thus, the printer 1 is allowed to print an image or the like by ejecting ink droplets of these colors onto the sheet 3 by the corresponding line heads.

Figure 2:
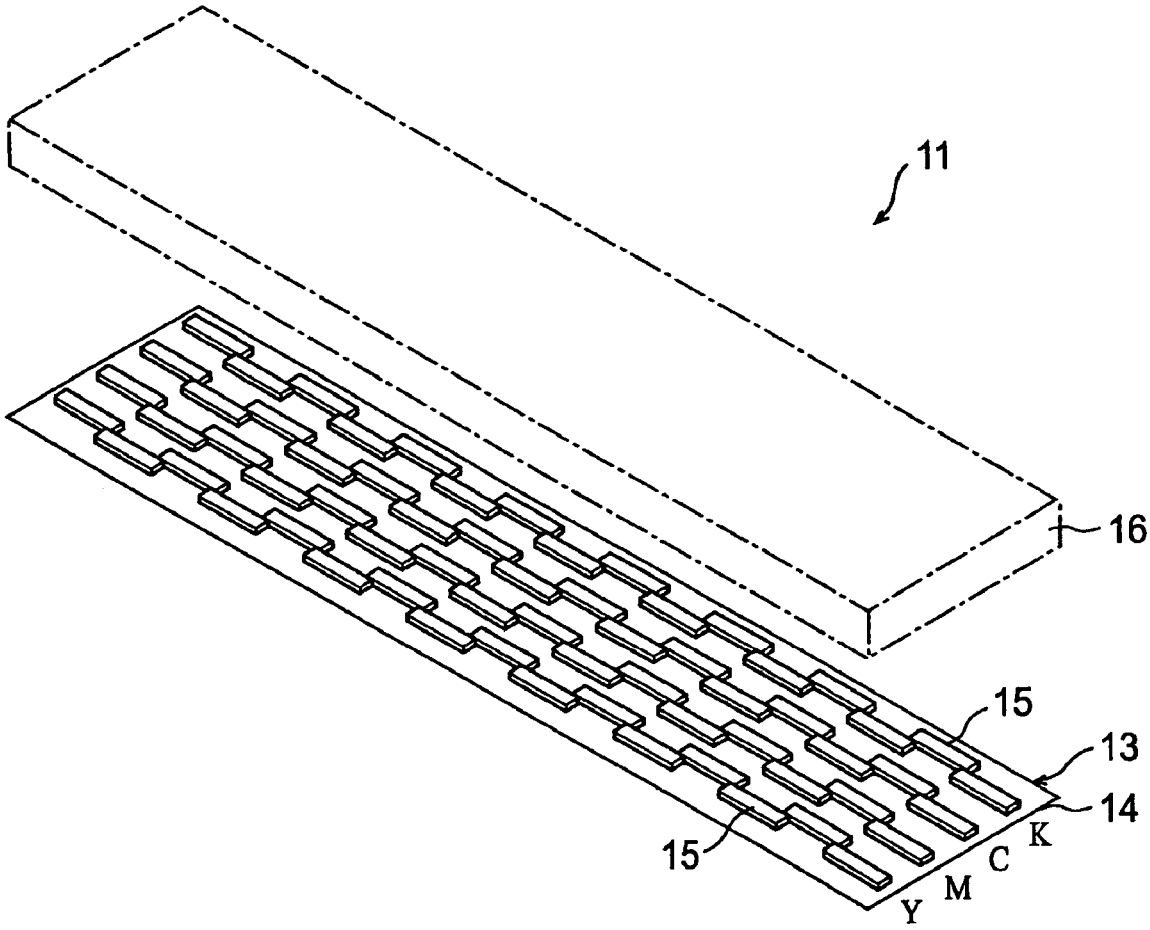
FIG. 2 is an exploded perspective view showing an embodiment of a printer head according to the present invention.

As shown in FIG. 2, in the printer head 11, an orifice plate 13 is provided, which is manufactured by forming nozzles and other parts on a sheet material composed of, for example, a carbon-based resin. The orifice plate 13 is held by a frame that is not shown. A dry film 14 having a predetermined shape, composed of the same carbon-based resin, is disposed on the orifice plate 13, and then a plurality of head chips 15 is sequentially arranged. The head chips 15 are arranged in four lines extending in a direction traversing the sheet 3 shown in FIG. 1, allowing printing of yellow Y, magenta M, cyan C, and black K. Thus, for example, a line head including 64 head chips 15 in total is provided.

Then, a metallic plate 16 having concavities and convexities on a surface associated with the head chips 15 and having ink channels with the ink cartridges Y, M, C, and K shown in FIG. 1 is disposed, and then the head chips 15 are connected, whereby the printer head 11 is formed.

Figure 3:
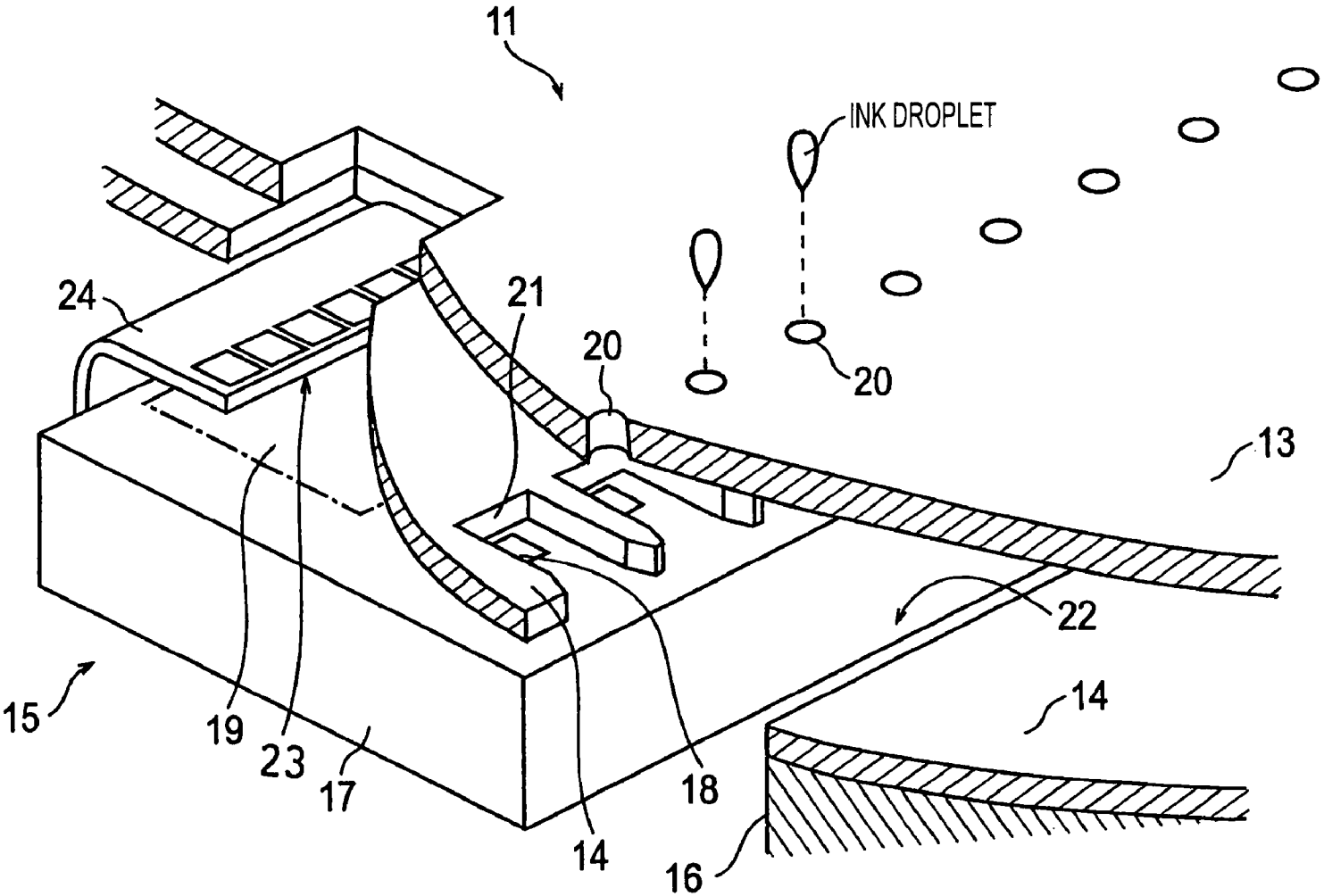
FIG. 3 is a sectional view showing a head chip assembled into the printer head, together with peripheral parts.

FIG. 3 is sectional view showing a head chip 15 assembled into the printer head 11 as described above, together with peripheral parts. The head chip 15 is formed by processing a silicon substrate (semiconductor substrate) 17 by integrated circuit technology. On the silicon substrate 17, heaters 18 for heating ink are sequentially arranged, and a driving circuit 19 for driving the heaters 18 is provided.

The orifice plate 13 is held such that nozzles 20 defined by openings having circular sections are located above the respective heaters 18, and the dry film 14 forms walls or the like for the heaters 18. Thus, ink chambers 21 are formed respectively in regions of the heaters 18, so that ink droplets can be ejected by a thermal ink-jet mechanism from the nozzles 20 provided in the orifice plate 13.

In the head chip 15 described above, the heaters 18 are disposed in the proximity of a side edge of the silicon substrate 17. The dry film 14 forms comb-shaped walls such that the ink chambers 21 are exposed along the side edge where the heaters 18 are disposed. The metallic plate 16 and the dry film 14 form ink channels 22 so as to allow ink of the ink cartridges Y, M, C, and K (refer to FIG. 1) to flow from the side where the ink chambers 21 are exposed. Thus, ink is allowed to flow from one side with respect to the lengthwise direction of the head chip 15 to the ink chambers 21 of the respective heaters 18.

On the opposite side of the side edge where the heaters 18 are disposed, pads 23 are provided and a flexible wiring board 24 is connected to the pads 23 to allow driving of the head chips 15. Thus, in the printer head 11, ink ejecting mechanisms that allow emission of ink droplets are formed by the heaters 18, the ink chambers 21, and the nozzles 20, and the heaters 18 constituting part of the ink ejecting mechanism are sequentially arranged, whereby the head chip 15 is formed.

Figure 4:
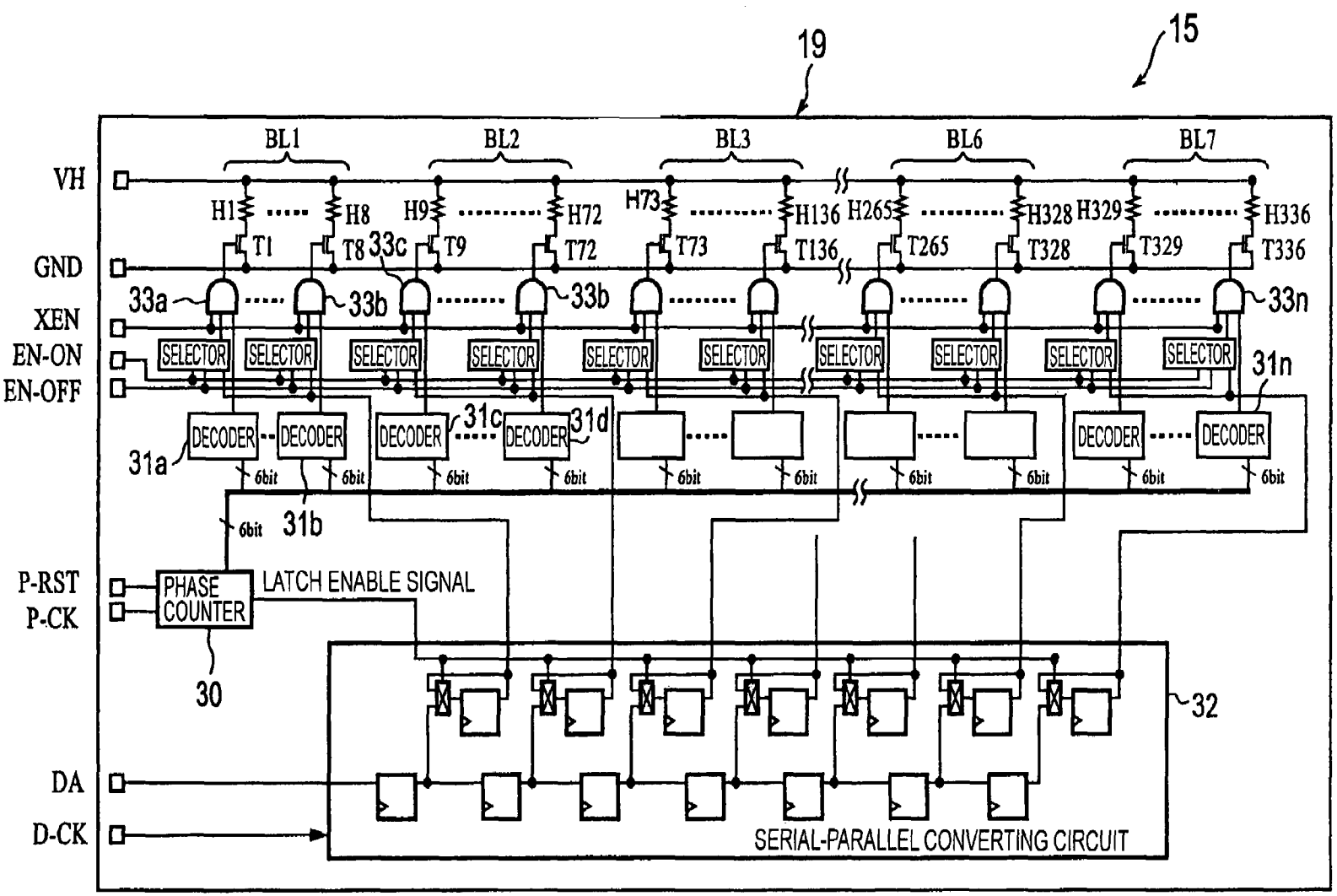
FIG. 4 is a block diagram showing a driving circuit of the printer head shown in FIGS. 2 and 3.

FIG. 4 is a block diagram showing the driving circuit 19 of the printer head 11 shown in FIGS. 2 and 3. The driving circuit 19 divides a plurality of ink ejecting mechanisms sequentially arranged on the silicon substrate 17 and having the nozzles 20 for ejecting ink into a plurality of blocks by groups of a predetermined number of units, and the plurality of blocks are dividedly driven concurrently with reference to a predetermined driving timing signal, thereby causing ink to be ejected from the nozzles 20.

Referring to FIG. 4, assuming that one head chip 15 includes 336 nozzles 20, the heaters 18 include 336 heaters H1 to H336, and 336 driving transistors (e.g., field-effect transistors) T1 to T336 for driving the heaters are provided. In order to dividedly drive these parts, the parts are divided into a plurality of blocks by groups of 64 units. In this case, since 336 is not divisible by 64, a first block BL1 and a seventh block BL7 each include 8 units, and a second block BL2 to a sixth block BL6 each include 64 units, dividing the parts into 7 blocks in total.

The driving circuit 19 shown in FIG. 4 includes a phase generating circuit (30, 31) and a serial/parallel converting circuit 32. The phase generating circuit generates phase signals for dividedly driving the groups of ink ejecting mechanisms, and it includes a phase counter 30 and decoders 31.

The phase counter 30 generates phase signals with input of two lines of signals, namely, a phase reset signal P-RST and a phase clock P-CK, for dividedly driving the seven blocks of the heaters H1 to H336 and the driving transistors T1 to T336. The phase counter 30 is implemented by a 6-bit counter since one block includes-64 units. The counter value of the phase counter 30 is reset to zero when the phase reset signal P-RST is input, and is counted up by one each time the phase clock P-CK is input, outputting six lines of phase signals.

The decoders 31 receive input of phase signals from the phase counter 30 and decode the phase signals. The decodes 31 are provided on a one-to-one basis for the respective nozzles 20 of the plurality of ink ejecting mechanisms, i.e., the heaters H1 to H336 and the driving transistors T1 to T336. For example, 336 decoders are provided as denoted by 31*a* to 31*n*.

The serial/parallel converting circuit 32 parallel converts and serially transfers data for dividedly driving the groups of ink ejecting mechanisms, i.e., the heaters H1 to H336 and the driving transistors T1 to T336. The serial/parallel converting circuit 32 receives input of two lines of signals, namely, driving data DA and a data transfer clock D-CK for divided driving, and parallel converts and serially transfers data. The serial/parallel converting circuit 32 is implemented by, for example, a combination of serially connected and parallel connected D flip-flops. In this case, the progress of phase in the phase counter 30 is synchronized with the timing of latching driving data DA in the serial/parallel converting circuit 32. Thus, data latch signals are internally generated by the serial/parallel converting circuit 32 with input of a latch enable signal from the phase counter 30. In the embodiment shown in FIG. 4, since the ink ejecting mechanisms are divided into seven blocks, the parallel output from the serial/parallel converting circuit 32 has seven bits.

The phase signals decoded by the decoders 31*a* to 31*n* are transmitted to the heaters H1 to H336 via AND circuits 33*a* to 33*n* connected to the driving transistors T1 to T336.

Figure 5:
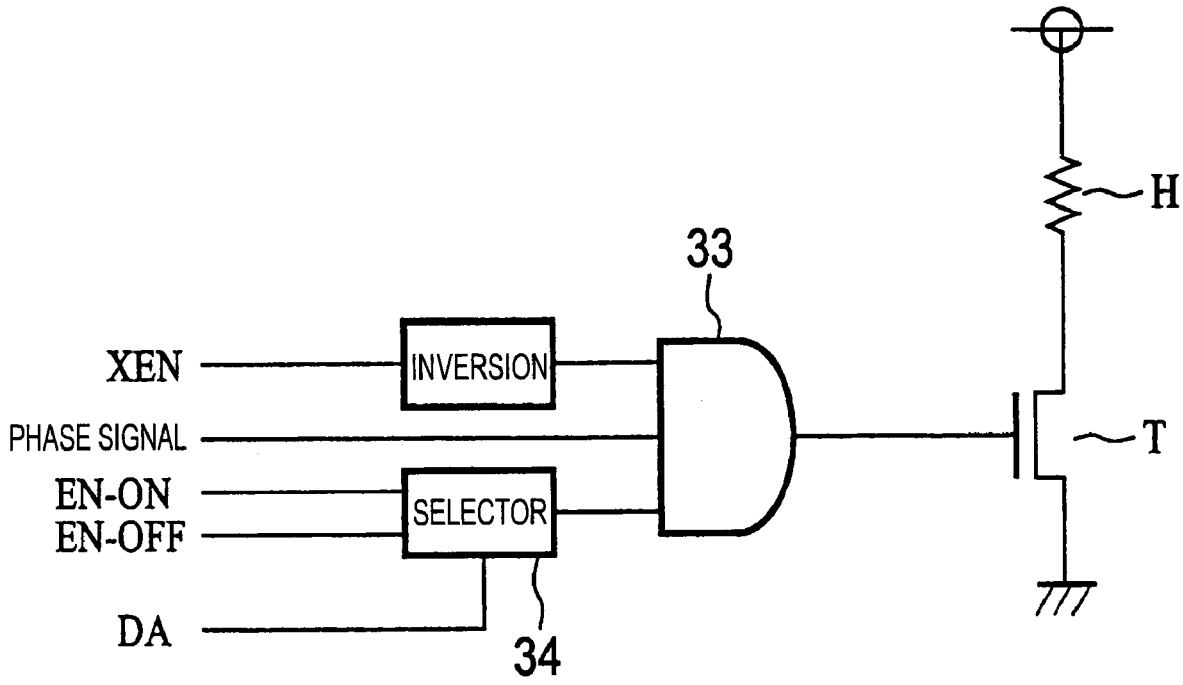
FIG. 5 is a block diagram for explaining driving signals transmitted to ink ejecting mechanisms of the printer head (driving transistors and heaters), and operation thereof.

The driving signals transmitted to the driving transistors T1 to T336 and the heaters H1 to H336 in this case will be described with reference to FIG. 5. First, a selector 34 selects "EN-ON (enable-on)" when the driving data DA serially transferred from the serial/parallel converting circuit 32 is "H (high)" while selecting "EN-OFF (enable off)" when the driving data DA is "L (low)", outputting the result to an AND circuit 33. Also, a "phase signal" in which only one phase among the 64 phases decoded by the decoders 31 is active is transmitted to the AND circuit 33. The AND circuit 33, taking the positive logic of the "phase signal", "EN-ON or EN-OFF signal", and "XEN (chip select) signal", turn on the relevant one of the driving transistors T1 to T336 when all of these signals are "H", whereby electricity is supplied to one of the heaters H1 to H336 connected thereto. Then, ink is ejected from the nozzle 20.

In this manner, data driven in the respective phases is transmitted to the driving transistors T1 to T336 and the heaters H1 to H336, driving all the nozzles 20, whereby ink droplets are ejected on a recording medium to form an image. In FIG. 4, the reference sign VH attached to a terminal of the head chip 15 denotes a power source for driving the heaters, and a reference sign GND denotes a ground terminal.

With the driving circuit 19 constructed as described above, it suffices to input only two lines of signals, namely, the phase reset signal P-RST and the phase P-CK, to the phase counter 30 for generating phase signals for dividedly driving the blocks of ink ejecting mechanisms. In this respect, conventionally, the number of phase signal lines needed is the same as the number of nozzles in one block, i.e., 64 phase signal lines are needed, as described earlier. Furthermore, it suffices to input only two lines of signals, namely, driving data DA and the data transfer clock D-CK, to the serial/parallel converting circuit 32 for transferring data for dividedly driving the groups of ink ejecting mechanisms divided into a plurality of blocks. In this respect, conventionally, the number of data lines needed is the same as the number of blocks of all the nozzles divided into a plurality of blocks, i.e., 6 or 7 data lines are needed, as described earlier.

Thus, the number of signal lines for dividedly driving blocks of ink ejecting mechanisms is reduced, for example, from 70 according to the conventional art to 4 according to the present invention.

Furthermore, in the head chip 15 shown in FIG. 4, the decoders 31*a* to 31*n* are provided on a one-to-one basis for the respective nozzles of the plurality of ink ejecting mechanisms, i.e., the heaters H1 to H336 and the driving transistors T1 to T336, and phase signals output from the phase counter 30 are decoded by the respective decoders 31*a* to 31*n*. Thus, the phase signals for divided driving, transmitted to the decoders 31 from the phase counter 30, are provided in accordance with the number of nozzles in one block (i.e., 64), for example, the output has 6 bits, so that six lines of phase signals suffice. Thus, as opposed to the conventional art in which 64 signal lines are needed for one block, the number of signal lines is reduced to, for example, six in the embodiment shown in FIG. 4. Thus, the wiring layout in a head chip is facilitated, and compact design of the head chip is allowed.

Figure 6:
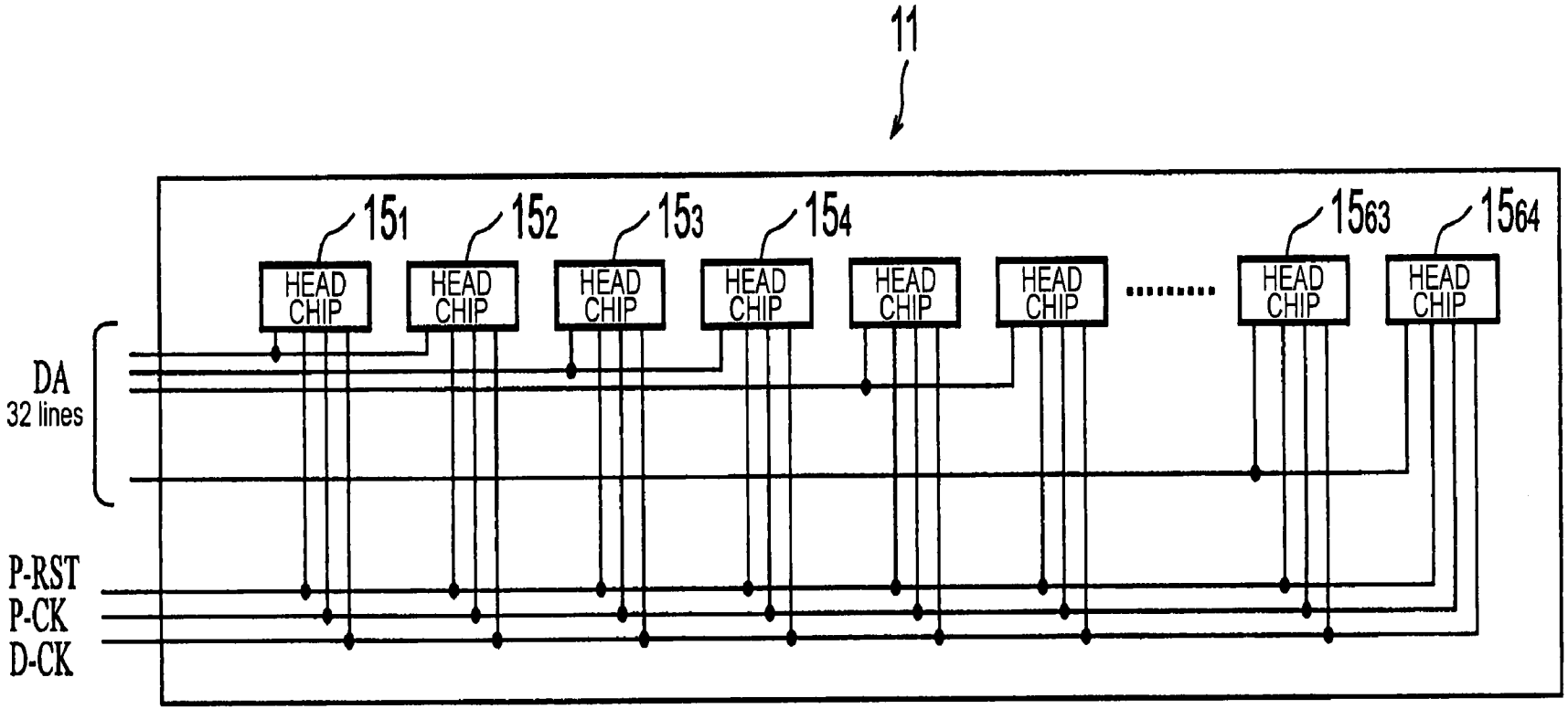
FIG. 6 is a schematic diagram showing another embodiment of a printer head according to the present invention.

FIG. 6 is a schematic diagram showing another embodiment of the printer head 11 according to the present invention. According to this embodiment, in a line head including, for example, 64 head chips, data lines for transmitting driving data for dividedly driving ink ejecting mechanisms to the head chips are provided such that each set of a predetermined plural number of head chips is commonly connected to one of the data lines, so that the data is transferred in a multiplexed manner.

More specifically, as shown in FIG. 6, assuming that 64 head chips $\mathbf{15}_1$ to $\mathbf{15}_{64}$ in total are provided, and considering two head chips as a set, one data line for driving data DA is commonly connected to the first head chip $\mathbf{15}_1$ and the second head chip $\mathbf{15}_2$, one data line is commonly connected to the third head chip $\mathbf{15}_3$ and the fourth head chip $\mathbf{15}_4$, and so forth, and one data line is commonly connected to the 63rd head chip $\mathbf{15}_{63}$ and the 64th head chip $\mathbf{15}_{64}$. Accordingly, driving data DA is transmitted in a multiplexed manner to the sets of two head chips via 32 data lines in total. In this case, other signal lines, namely, three signal lines for the phase reset signal P-RST, the phase clock P-CK, and the data transfer clock D-CK, are connected in parallel to the head chips $\mathbf{15}_1$ to $\mathbf{15}_{64}$.

Figures 7A, 7B, 7C, 7D:
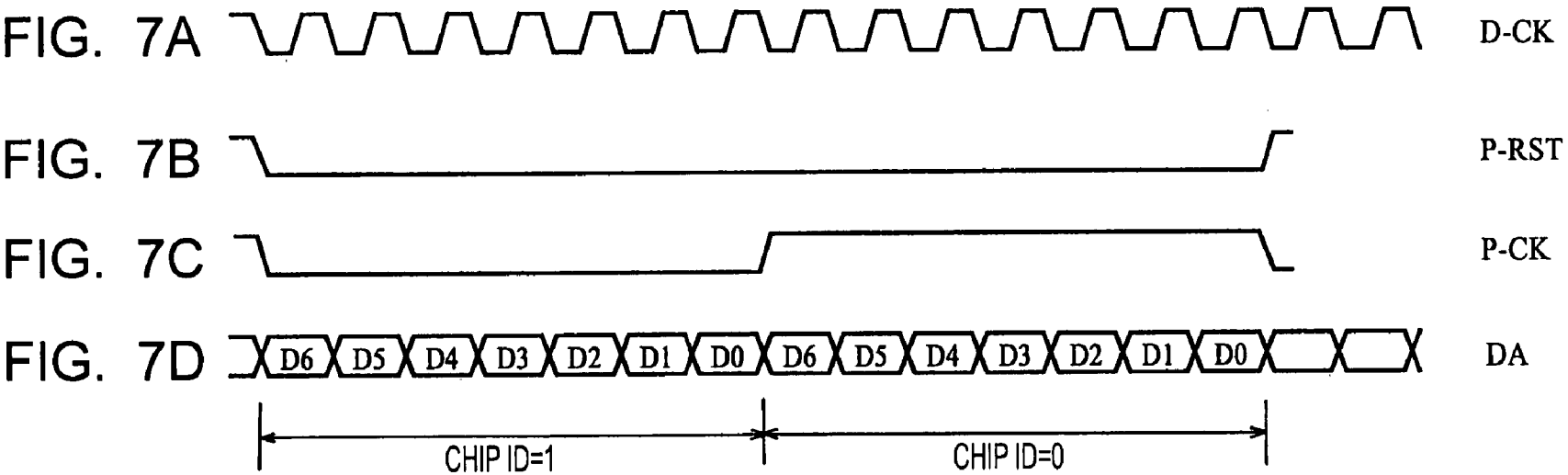
FIGS. 7A to 7D are timing charts for explaining multiplexed transmission of data in the printer head according to the another embodiment shown in FIG. 6.

The multiplexed transmission of data by the connection of data lines shown in FIG. 6 are controlled according to timing charts shown in FIGS. 7A to 7D. That is, for example, regarding a set of two head chips 15, a chip ID "1" is assigned to one head chip 15 and a chip ID "0" is assigned to the other head chip 15, and which data is to be received is determined based on the chip IDs (1 bit). For example, two types of latch signals are generated internally in the chips, and seven sets of data are received by each. Referring to FIG. 7D, whether seven sets of data D0 to D6 latched in the former half or seven sets of data D0 to D6 latched in the latter half are to be valid is determined based on the chip IDs. This allows multiplexed transmission of driving data DA to two head chips 15 by a single data line.

With the connection of data lines described above, for example, when the printer head 11 includes 64 head chips 15 in total, as opposed to a case where 64 data lines are needed, the number of data lines is reduced to, for example, one half, i.e., 32, according to the present invention. The number of total control signal lines including other signal lines is also reduced to 35. Thus, wiring space for the printer head 11 is reduced, and compact design of the printer head is allowed.

Although one data line is commonly connected to each set of two head chips 15 in FIG. 6, the present invention is not limited thereto, and one data line may be commonly connected to each set of three or more head chips 15. In that case, the number of data lines is further reduced by the reciprocal of an integer, such as ⅓ or ¼. In this case, the frequency of the data transfer clock D-CK must be increased as appropriate.

Although the printer head 11 includes a plurality of head chips 15 in the above description, the present invention is not limited thereto, and it is possible that the printer head 11 includes only one head chip 15. In that case, the another embodiment shown in FIGS. 6 and 7A to 7D is not applicable.

Although embodiments of the present invention have been described above, the present invention is not limited to the above-described embodiments, and various modifications are possible.

For example, although the above description has dealt with examples where the present invention is applied to a thermal liquid ejecting head, liquid ejecting device, and liquid ejecting method, without limitation to the examples, the present invention can be applied to any energy generating element that generates energy for ejecting droplets.

Furthermore, although the above description has dealt with examples where the present invention is applied to printers, obviously, the present invention can be applied to image forming apparatuses such as facsimile machines or copying machines, and to image forming methods therefor. Furthermore, without limitation to the above-mentioned image forming apparatuses or the like, the present invention can be applied to various liquid ejecting devices. For example, the present invention can be applied to a device for ejecting DNA-containing solution for detecting a biological sample, or a printed-board manufacturing device for forming a wiring pattern, characters, a resist pattern, or the like on a printed board.

The present invention is not limited to the embodiments described above with reference to the drawings, and it is apparent to those skilled in the art that various modifications, alternatives, or equivalents can be conceived without departing from the appended claims or the gist thereof.

INDUSTRIAL APPLICABILITY

A liquid ejecting head, a liquid ejecting device, and a liquid ejecting method according to the present invention allow a plurality of liquid ejecting mechanisms of a head chip to be divided into a plurality of blocks by groups of a predetermined number of units and so that the blocks are dividedly driven concurrently. The number of control signal lines for exercising control for divided driving of the head chip is reduced. Furthermore, wiring space for a liquid ejecting head is reduced, and compact design of a liquid ejecting head is allowed.

The invention claimed is:

1. A liquid ejecting head comprising:

a head chip, the head chip including a plurality of liquid ejecting mechanisms having nozzles for ejecting liquid, and a driving circuit for driving a plurality of blocks of a predetermined number of liquid ejecting mechanisms and for dividedly driving the plurality of blocks thereby causing liquid to be ejected from the nozzles, wherein the driving circuit of the head chip includes a serial/parallel converting circuit wherein each parallel output is applied to all liquid ejecting mechanisms of a single block, and wherein each liquid ejecting mechanism has a dedicated corresponding decoder which receives a parallel output from a counter that counts a phase clock pulse and further wherein the serial/parallel converting circuit receives a serial input data signal and a data clock, the output from the decoder being applied as an enable signal for the liquid ejecting mechanism.

2. The liquid ejecting head according to claim 1, wherein the serial/parallel converting circuit receives input of two lines of signals that serve as a driving data signal and a data transfer clock for dividedly driving each block.

3. A liquid ejecting head comprising:

a plurality of head chips, each of the plurality of head chips including a plurality of liquid ejecting mechanisms, and a driving circuit for driving a plurality of blocks of a predetermined number of liquid ejecting mechanisms and for dividedly driving the plurality of blocks, thereby causing liquid to be ejected from the nozzles, and wherein the driving circuit of each of the head chips includes a serial/parallel converting circuit wherein each parallel output is applied to all liquid ejecting mechanisms of a single block, wherein each liquid ejecting mechanism has a dedicated corresponding decoder which receives a parallel output from a counter that counts a phase clock pulse and further wherein the serial/parallel converting circuit receives a serial input data signal and a data clock, the output from the decoder being applied as an enable signal for the liquid ejecting mechanism.

4. A liquid ejecting device comprising:

a head chip, the head chip including a plurality of liquid ejecting mechanisms having nozzles for ejecting liquid, and a driving circuit for driving a plurality of blocks of a predetermined number of liquid ejecting mechanisms and for dividedly driving the plurality of blocks thereby causing liquid to be ejected from the nozzles, the liquid ejecting device allowing droplets to be ejected onto a recording medium from the nozzles of the liquid ejecting mechanisms, and wherein each liquid ejecting mechanism has a dedicated corresponding decoder which receives a parallel output from a counter that counts a phase clock pulse and further wherein the serial/parallel converting circuit receives a serial input data signal and a data clock, the output from the decoder being applied as an enable signal for the liquid ejecting mechanism and a logic gate corresponding to each liquid ejecting mechanism receives a further enable signal and an output from the decoder.

5. The liquid ejecting device according to claim 4, wherein the serial/parallel converting circuit receives input of two lines of signals that serve as a driving data signal and a data transfer clock for dividedly driving each block.

6. A liquid ejecting device comprising:

a plurality of head chips, each of the plurality of head chips including a plurality of liquid ejecting mechanisms, and a driving circuit for driving a plurality of blocks of a predetermined number of liquid ejecting mechanisms and for dividedly driving the plurality of blocks concurrently, thereby causing liquid to be ejected from the nozzles, the liquid ejecting device allowing droplets to be ejected onto a recording medium from the nozzles of the liquid ejecting mechanisms, and wherein the driving circuit of each of the head chips includes a serial/parallel converting circuit wherein each parallel output is applied to all liquid ejecting mechanisms of a single block, wherein each liquid ejecting mechanism has a dedicated corresponding decoder which receives a parallel output from a counter that counts a phase clock pulse and further wherein the serial/parallel converting circuit receives a serial input data signal and a data clock, the output from the decoder being applied as an enable signal for the liquid ejecting mechanism and a logic gate corresponding to each liquid ejecting mechanism receives a further enable signal and an output from the decoder and wherein data lines for transmitting the data for dividedly driving the liquid ejecting mechanisms to the head chips are provided such that each set of a predetermined plural number of head chips is commonly connected to one of the data lines, so that the data is transmitted in a multiplexed manner.

7. A liquid ejecting method for ejecting liquid from a plurality of liquid ejecting mechanisms, wherein the plurality of liquid ejecting mechanisms is divided into a plurality of blocks of a predetermined number of liquid ejecting mechanisms and each liquid ejecting mechanism has a dedicated corresponding one of a plurality of decoders, enable signals for selectively driving the liquid ejecting mechanisms of each block are generated based on a count of a phase clock input which is decoded by each decoder and output to each corresponding liquid ejecting mechanism, a single parallel output signal per block is applied to all liquid ejecting mechanisms in each block, and the liquid ejecting mechanisms are selectively driven, thereby causing liquid to be ejected from the liquid ejecting mechanisms.

8. A liquid ejecting method for ejecting liquid from a liquid ejecting head comprising:

a plurality of head chips, each of the plurality of head chips including a plurality of liquid ejecting mechanisms, and wherein the plurality of liquid ejecting mechanisms is divided into a plurality of blocks of a predetermined number of liquid ejecting mechanisms and each liquid ejecting mechanism has a dedicated corresponding decoder which receives a parallel output from a counter that counts a phase clock pulse and further wherein the serial/parallel converting circuit receives a serial input data signal and a data clock, the output from the decoder being applied as an enable signal for the liquid ejecting mechanism and a logic gate corresponding to each liquid ejecting mechanism receives a further enable signal and an output from the decoder and a single parallel output signal per block is applied to all liquid ejecting mechanisms in each block.

* * * * *